US010004267B2

(12) United States Patent
Liu

(10) Patent No.: US 10,004,267 B2
(45) Date of Patent: Jun. 26, 2018

(54) ATOMIZATION ASSEMBLY AND ELECTRONIC CIGARETTE

(71) Applicant: KIMREE HI-TECH INC., Road Town, Tortola (VG)

(72) Inventor: Qiuming Liu, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 0 days. days.

(21) Appl. No.: 15/312,830

(22) PCT Filed: May 21, 2014

(86) PCT No.: PCT/CN2014/077982

§ 371 (c)(1),
(2) Date: Nov. 21, 2016

(87) PCT Pub. No.: WO2015/176245

PCT Pub. Date: Nov. 26, 2015

(65) Prior Publication Data

US 2017/0156400 A1 Jun. 8, 2017

(51) Int. Cl.

| | |
|---|---|
| ***A24F 17/00*** | (2006.01) |
| ***A24F 47/00*** | (2006.01) |
| ***H05B 1/02*** | (2006.01) |

(52) U.S. Cl.

CPC ..... *A24F 47/008* (2013.01); *H05B 1/0244* (2013.01); *H05B 2203/021* (2013.01)

(58) Field of Classification Search

CPC ..... A24F 47/008; H05B 1/0244; H05B 2203/021

(Continued)

(56) References Cited

U.S. PATENT DOCUMENTS

2017/0156400 A1* 6/2017 Liu ..... A24F 47/008

FOREIGN PATENT DOCUMENTS

| | | |
|---|---|---|
| CN | 201379072 Y | 1/2010 |
| CN | 101986906 A | 3/2011 |

(Continued)

OTHER PUBLICATIONS

International Search Report (ISR) issued by the State Intellectual Property Office of the Peoples Republic of China dated Feb. 25, 2015 for PCT/CN2014/077982.

*Primary Examiner* — Khiem Nguyen
(74) *Attorney, Agent, or Firm* — Tim Tingkang Xia, Esq.; Locke Lord LLP

(57) ABSTRACT

An atomization assembly and an electronic cigarette are provided. The atomization assembly configured to combine with a battery assembly to form the electronic cigarette comprises an atomizer and an oil container detachably connected to one end of the atomizer. A smoke outlet configured to discharge atomized smoke is defined on the other end of the atomizer, away from the oil container. The atomizer comprises an atomization sleeve; a heating wire assembly provided in the atomization sleeve, and an oil delivery mechanism inserted in the oil container and configured to deliver the oil to be atomized to the heating wire assembly. The heating wire assembly comprises a liquid delivery element extended along an axial direction of the atomizer, and a heating wire twined around the liquid delivery element.

4 Claims, 5 Drawing Sheets

(58) Field of Classification Search
USPC ..... 131/329
See application file for complete search history.

(56) References Cited

FOREIGN PATENT DOCUMENTS

| | | | |
|---|---|---|---|
| CN | 103202537 | A | 7/2013 |
| CN | 203087526 | U | 7/2013 |
| CN | 203194539 | U | 9/2013 |
| CN | 203327956 | U | 12/2013 |
| CN | 203467677 | U | 3/2014 |
| CN | 203505586 | U | 4/2014 |
| CN | 203952430 | U | 11/2014 |
| WO | 2011146315 | A2 | 11/2011 |

* cited by examiner

ATOMIZATION ASSEMBLY AND ELECTRONIC CIGARETTE

FIELD OF THE INVENTION

The present invention relates to the field of electronic heating products. More specifically, the present invention relates to an atomization assembly and an electronic cigarette.

BACKGROUND OF THE INVENTION

Referring to FIG. 1, FIG. 1 shows the structure of an atomizer in the prior art. From FIG. 1 we can know that the atomizer is used to atomize oil to form smoke supplied to users. The specific implementation is that a vent tube 102 is provided in an atomization sleeve 105 and an oil-absorbing cotton 101 configured to store oil is wrap around an outside of the vent tube 102. A glass fiber line 103 is provided in the vent tube 102. The two ends of the glass fiber line 103 pass through the vent tube 102 and plug in the oil-absorbing cotton 101. A heating wire 104 configured to atomize oil is twined around the glass fiber line 103. An axial direction of the heating wire 104 is perpendicular to that of the atomizer. The oil in the oil-absorbing cotton 101 flows to the heating wire 104 through the vent tube 102 and the glass fiber line 103, so that the heating wire 104 can atomize the oil to form the smoke.

At the present, the diameter of the heating wire 104 is 0.08-0.13 mm. The diameter of the heating wire 104 is small, so the contact area with the glass fiber line 103 is small and the temperature for atomizing oil is 220°-300°. In order to increase the volume of the smoke to meet the demands of the users with large vital capacity, the current flowing through the heating wire 104 is increased and the temperature of the heating wire 104 energized is 300°-600°. However, it is easy to burn the oil-absorbing cotton 101 in this way and the lifetime of the electronic cigarette will be affected. Additionally, the volume of the smoke can also be increased by increasing the length of the heating wire 104. However, as the electronic cigarette is used to simulate conventional cigarette, it is more acceptable that the size of the electronic cigarette is comparative to that of the conventional cigarette. Accordingly, the cross sectional areas of the electronic cigarette and the vent tube 102 in the electronic cigarette is limited. The increasable length of the heating wire 104 is limited because of the limited cross sectional area of the vent tube 102, and the increasable volume of the smoke is hence also limited and can't meet the users' demands.

Additionally, the oil-absorbing cotton 101 configured as an oil container and the atomizer are integrally formed, which can't be detached. Moreover, the oil container is close to a mouthpiece and is provided in the smoking channel, so the oil in the oil container can easily leak to the smoking channel, which makes the users suck the un-atomized oil and it hence affects users' health.

SUMMARY OF THE INVENTION

To solve the said drawbacks in prior art, the present invention provides an atomization assembly and an electronic cigarette.

The technical solutions of the present invention for solving the technical problems are as follows:

An atomization assembly, configured to combine with a battery assembly to form an electronic cigarette is provided;

the atomization assembly comprises an atomizer, and an oil container detachably connected to an end of the atomizer; a smoke outlet configured to discharge atomized smoke is defined on the other end of the atomizer, opposite to the oil container; the atomizer comprises an atomization sleeve, a heating wire assembly provided in the atomization sleeve, and an oil delivery mechanism inserted into the oil container and configured to deliver oil to the heating wire assembly to be atomized; the heating wire assembly comprises a liquid delivery element extended along an axial direction of the atomizer, and a heating wire twined around the liquid delivery element.

In the atomization assembly of the present application, the oil delivery mechanism comprises an oil conduit, and an oil latch element received in the oil conduit and made of oil absorption material; an external peripheral wall of the oil latch element is fit with an internal peripheral wall of the oil conduit; the heating wire assembly is received in the oil conduit; an end of the liquid delivery element abuts against the oil latch element;

a first electrode connecting element configured to electronically connected to the battery assembly is inserted in an end of the oil conduit; the heating wire is electronically connected to the first electrode connecting element.

In the atomization assembly of the present application, an opening is defined on an end of the oil container, facing the atomizer; the oil delivery mechanism is inserted into the oil container through the opening; an elastic sealing element configured to seal oil is sleeved on the oil conduit, corresponding to the opening.

In the atomization assembly of the present application, the oil latch element and the liquid delivery element are both in form of a solid cylinder; an axis of the liquid delivery element is overlapped with or parallel to that of the oil latch element, and a cross sectional area of the oil latch element is greater than that of the liquid delivery element.

In the atomization assembly of the present application, at least one nonwoven fabric layer, a cotton core layer and a composite cotton layer are successively provided in the oil latch element; the liquid delivery element abuts against the nonwoven fabric layer.

In the atomization assembly of the present application, at least one nonwoven fabric layer is provided between the cotton core layer and the composite cotton layer.

In the atomization assembly of the present application, a fixed sleeve made of glass fiber is sleeved with the oil conduit, and one end of the fixed sleeve is connected to the first electrode connecting element by a plug connection; the heating wire assembly is received in the fixed sleeve.

In the atomization assembly of the present application, the first electrode connecting element comprises a first electrode, a second electrode, and a first insulating ring sleeved between the first electrode and the second electrode and configured for electrical insulation; the first electrode and the second electrode are respectively and electronically connected to the two ends of the heating wire.

In the atomization assembly of the present application, a first connecting element configured to detachably connect to the battery assembly is connected to one end of the atomization sleeve; the first electrode connecting element is provided in the first connecting element;

a second connecting element configured to detachably connect to the oil container is provided in the other end of the atomization sleeve.

An electronic cigarette comprising an electronic cigarette body is further provided in the present application; a smoking end, an atomization assembly configured to atomize oil and a battery assembly electrically connected to the atomization assembly and configured to supply power to the atomization assembly are provided on the electronic cigarette body; the atomization assembly comprises an atomizer, and an oil container detachably connected to one end of the atomizer; a smoke outlet configured to discharge atomized smoke is defined on the other end of the atomizer, opposite to the oil container; the oil container is arranged at one end of the electronic cigarette body, opposite to the smoking end;

the atomizer comprises an atomization sleeve, a heating wire assembly provided in the atomization sleeve, and an oil delivery mechanism inserted into the oil container and configured to deliver oil to the heating wire assembly to be atomized; the heating wire assembly comprises a liquid delivery element extended along an axial direction of the atomizer, and a heating wire twined around the liquid delivery element.

In the electronic cigarette of the present application, the oil delivery mechanism comprises an oil conduit, and an oil latch element received in the oil conduit and made of oil absorption material; an external peripheral wall of the oil latch element is fit with an internal peripheral wall of the oil conduit; the heating wire assembly is received in the oil conduit; an end of the liquid delivery element abuts against the oil latch element;

a first electrode connecting element configured to electronically connected to the battery assembly is inserted in an end of the oil conduit; the heating wire is electronically connected to the first electrode connecting element.

In the electronic cigarette of the present application, an opening is defined on an end of the oil container, facing the atomizer; the oil delivery mechanism is inserted into the oil container through the opening; an elastic sealing element configured to seal oil is sleeved on the oil conduit, corresponding to the opening.

In the electronic cigarette of the present application, the oil latch element and the liquid delivery element are both in form of a solid cylinder; an axis of the liquid delivery element is overlapped with or parallel to that of the oil latch element, and a cross sectional area of the oil latch element is greater than that of the liquid delivery element.

In the electronic cigarette of the present application, a fixed sleeve made of glass fiber is sleeved with the oil conduit, and one end of the fixed sleeve is connected to the first electrode connecting element by a plug connection; the heating wire assembly is received in the fixed sleeve.

In the electronic cigarette of the present application, the first electrode connecting element comprises a first electrode, a second electrode, and a first insulating ring sleeved between the first electrode and the second electrode and configured for electrical insulation; the first electrode and the second electrode are respectively and electronically connected to the two ends of the heating wire.

In the electronic cigarette of the present application, a first connecting element configured to detachably connect to the battery assembly is connected to one end of the atomization sleeve; the first electrode connecting element is provided in the first connecting element;

a second connecting element configured to detachably connect to the oil container is provided in the other end of the atomization sleeve.

In the electronic cigarette of the present application, the battery assembly comprises a battery sleeve; a third connecting element configured to connect to atomization assembly is connected to one end of the battery sleeve; a second electrode connecting element electronically connected to the atomization assembly is provided on the third connecting element.

In the electronic cigarette of the present application, a battery configured to supply power to the atomization assembly, a battery bracket configured to fix the battery, an airflow sensor configured to produce a trigger signal, a control unit configured to control the battery assembly to supply power to the atomization assembly are provided in the battery sleeve; the control unit is respectively and electronically connected to the airflow sensor and the battery.

In the electronic cigarette of the present application, a smoking channel connected to the smoking end and configured to discharge the smoke formed in the process of atomizing oil by the heating wire assembly is formed in the electronic cigarette body.

In the electronic cigarette of the present application, the atomizer is provided between the battery assembly and the oil container, and is coaxial with the battery assembly and the oil container.

When implementing the atomization assembly and electronic cigarette of the present application, the following advantageous effects can be achieved: firstly, by providing the liquid delivery element of the heating wire assembly along the axial direction of the atomizer, the length of the heating wire twined around the liquid delivery element can be increased sharply to further increase the volume of the smoke, so enough smoke can be sucked by the users, the demands of the users with large vital capacity can be met and the using experience of the uses can be improved; secondly, by providing the oil container which is detachably connected to one end of the electronic cigarette body, opposite to the smoking end, it is convenient to add oil and the situation that it is inconvenient to observe the volume of added oil when adding oil into the oil-absorbing cotton and that it is easy to inject oil to the smoking channel can be avoided; with the structure of the present invention, the smoking channel of the electronic cigarette doesn't pass through the oil container, the situation that the oil flow into the smoking channel is prevented and the situation that the smoke is condensed due to the heat of the smoke being absorbed by the oil can be avoided, so the users can be prevented from sucking the oil and influencing users' experience; finally, by clamping, the first electrode and the second electrode are electrically connected to the heating wire, thus the welding connection in prior art can be avoided; therefore, the atomizer can be assembled without complex operations, it is convenient for assemblers, the assembling efficiency can be improved, production coast can be saved and the requirement to assemblers is reduced.

BRIEF DESCRIPTION OF THE DRAWINGS

The present invention will be further described with reference to the accompanying drawings and embodiments in the following, in the accompanying drawings.

DETAILED DESCRIPTION OF THE PREFERRED EMBODIMENTS

Figure 1:
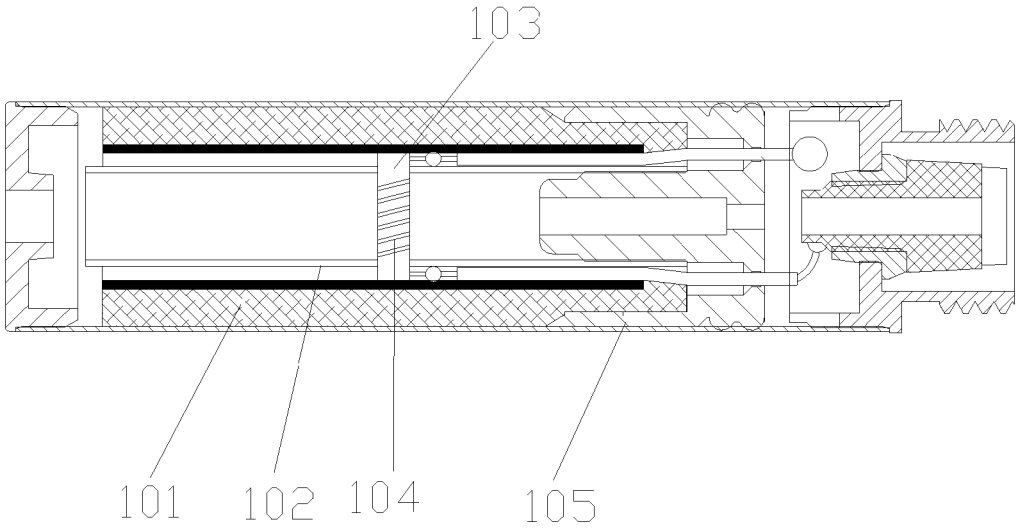
FIG. 1 is a sectional view of an electronic cigarette in the prior art.

In order to explain the purpose, the technical features, and the effect of the present application more clearly, the specific embodiments of the present application will be described in detail referring to the drawings. Understandably, the specific embodiments described here are only used to explain the present application, but not to limit the present application.

Figure 2:
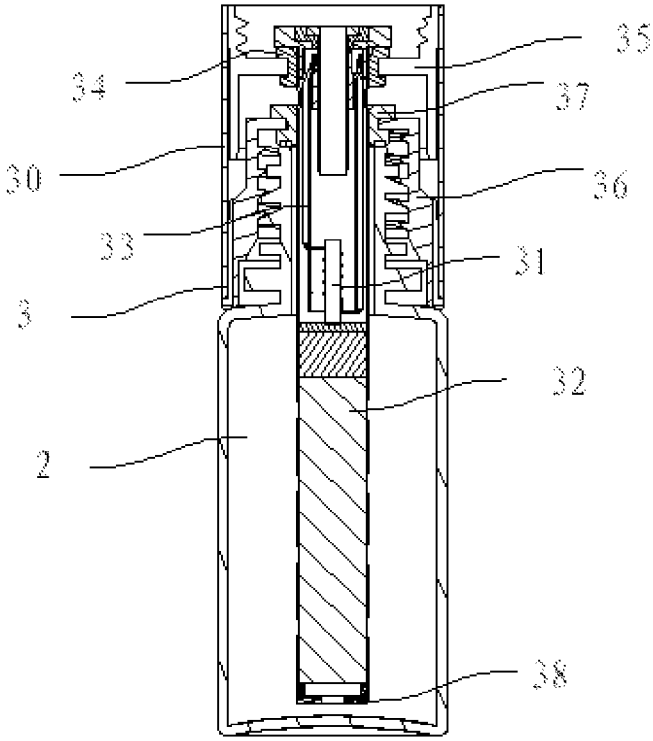
FIG. 2 is a structural diagram of an atomization assembly according to a preferred embodiment of the present invention.

As shown in FIG. 2, an atomization assembly according to a preferred embodiment of the present invention is provided. The atomization assembly is configured to combine with a battery assembly 4 (see FIG. 6) to form an electronic cigarette. The atomization assembly mainly comprises an atomizer 3, and an oil container 2 detachably connected to one end of the atomizer 3. A smoke outlet configured to discharge atomized smoke is defined on the other end of the atomizer 3, opposite to the oil container 2. The atomizer 3 comprises an atomization sleeve 30, a heating wire assembly 31 provided in the atomization sleeve 30, and an oil delivery mechanism 32 inserted into the oil container 2 and configured to deliver oil to the heating wire assembly 31 to be atomized. The heating wire assembly 31 comprises a liquid delivery element 311 (see FIG. 3) extended along an axial direction of the atomizer 3, and a heating wire 312 twined around the liquid delivery element 311.

Further, a first electrode connecting element 34 electronically connected to the heating wire assembly 31 and a fixed sleeve 33 abutted against the first electrode connecting element 34 are provided in one end of the atomization sleeve 30. The heating wire assembly 31 is received in the fixed sleeve 33, and the liquid delivery element 311 is fixed along an axial direction of the fixed sleeve 33.

In a traditional electronic cigarette, the liquid delivery element 311 is fixed along a radial direction of the fixed sleeve 33. As the radial length of the fixed sleeve 33 is limited, the length of the heating wire 312 twined around the liquid delivery element 311 is hence limited. However, as the axial length of the fixed sleeve 33 is much greater than the radial length of the fixed sleeve 33, the length of the liquid delivery element 311 fixed along the axial direction of the fixed sleeve 33 is unlimited, and the length of the heating wire 312 twined around the liquid delivery element 311 can be set based on actual needs to increase the volume of the smoke to meet the demands of the users with large vital capacity. Furthermore, as the smoke is discharged from the end of the atomizer 3, opposite to the oil container 2, and as the oil container 2 is detachable, the probability that users suck the oil will be greatly reduced and it is convenient to add oil.

In the following, the specific structure of the atomizer 3 of the atomization assembly is described in detail combining with the embodiments shown in FIGS. 2 and 3.

The atomizer 3 is configured to atomize the oil stored the oil container 2. One end of the atomizer 3 is detachably connected to the oil container 2, and the other end of the atomizer 3 is detachably connected to the battery assembly 4.

Referring to FIG. 2, the atomizer 3 mainly comprises the atomization sleeve 30, the heating wire assembly 31, the oil delivery mechanism 32, the fixed sleeve 33, the first electrode connecting element 34, a first connecting element 35, a second connecting element 36, an elastic sealing element 37 and a bottom cap 38.

The atomization sleeve 30 is approximately in form of a hollow cylinder, and opens at both ends. The oil container 2 is connected to one end of the atomization sleeve 30, and the battery assembly 4 is connected to the other end of the atomization sleeve 30. An inlet hole (unlabeled) of the atomizer 3 may be defined on the atomization sleeve 30, or may be defined on a surface through which the atomization sleeve 30 abuts against the oil container 2.

The heating wire assembly 31 comprises the liquid delivery element 311 and the heating wire 312 twined around an outer surface of the liquid delivery element 311. The heating wire 312 is configured to atomize the oil in the oil container 2. In the embodiment, the liquid delivery element 311 is received in the fixed sleeve 33 along an axial direction. The liquid delivery element 311 is glass fiber line made of glass fiber material. The liquid delivery element 311 is capable of adsorbing oil and possesses good heat resistance, so it can be better prevented from burning. Preferably, the diameter of the glass fiber line is 1 mm-2.5 mm. In addition, the liquid delivery element 311 can be made of other material which isn't limited here.

In order to improve the volume of the smoke, make users such enough smoke and improve users' experience, the heating wire 312 is compacted to platy structure or the diameter of the heating wire 312 is increased to increase the contact area between the heating wire 312 and the liquid delivery element 311. For example, the heating wire 312 is made of nichrome wire with the resistance value of 1.5Ω-4.5Ω and the diameter of 0.12 mm-0.17 mm. In addition, the axis of the liquid delivery element 311 is set to be overlapped with or parallel to the axis of the fixed sleeve 33 to achieve the above effects. In order to improve product yield, assemble convenience and make the volume of the smoke as large as possible, in the embodiment, the axis of the liquid delivery element 311 overlaps with the axis of the fixed sleeve 33.

The oil delivery mechanism 32 is mainly configured to deliver the oil in the oil container 2 to the heating wire assembly 31 to be atomized. One end of the oil delivery mechanism 32 is inserted into the oil container 2 to absorb the oil stored in the oil container 2 and deliver the oil absorbed to the heating wire assembly 31 to be atomized.

Figure 3:
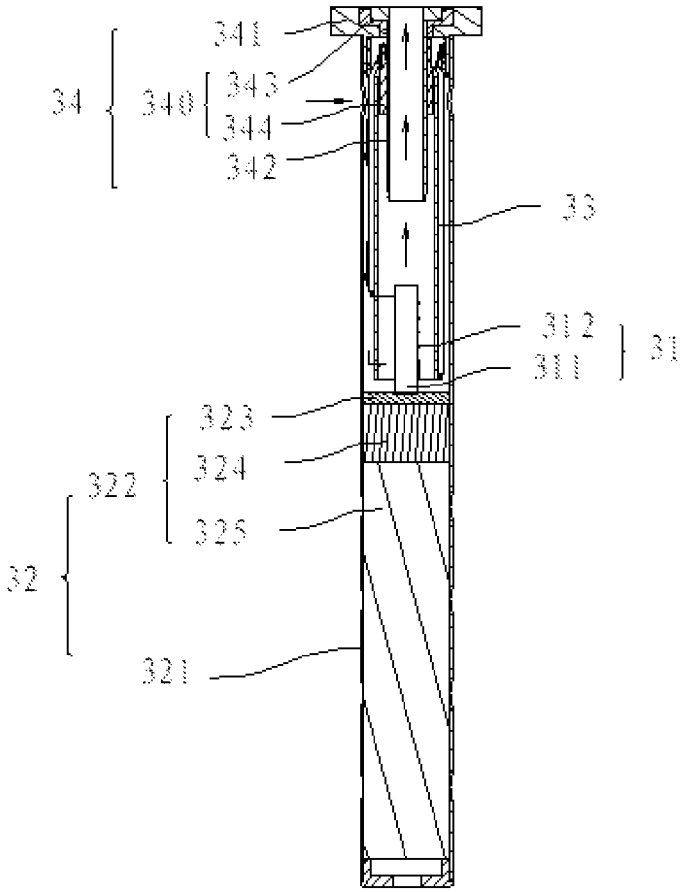
FIG. 3 is a structural diagram of a heating wire assembly, an oil delivery mechanism and a first electrode connecting element of the atomizer shown in FIG. 2 according to one embodiment of the present invention.

Referring to FIG. 3, the oil delivery mechanism 32 comprises an oil conduit 321, and an oil latch element 322 received in the oil conduit 321 and made of oil absorption material. One end of the oil conduit 321 is inserted into the oil container 2, and the other end of the oil conduit 321 abuts against the first electrode connecting element 34. The oil latch element 322 is fixed on one end of the oil conduit 321, close to the oil container 2, and the external peripheral wall of the oil latch element 322 is fit with the internal peripheral wall of the oil conduit 321. The heating wire assembly 31 is received in one end of the oil conduit 321, opposite to the oil container 2. One end of the liquid delivery element 311 of the heating wire assembly 31 abuts against the oil latch element 322.

Specifically, the oil latch element 322 and the liquid delivery element 311 are both in form of a solid cylinder and are coaxially arranged. The cross sectional area of the oil latch element 322 is greater than that of the liquid delivery element 311, so that the oil deliver path is in form of a ladder-like structure which can keep the oil latch element 322 at a saturated oil absorption condition and the liquid delivery element 311 at a moderate oil absorption condition. Thus the oil can be obtained from the oil latch element 322 by the liquid delivery element 311 at any time. Therefore, the volume of the smoke can be improved further and the situation that the heating wire assembly 31 runs dry can be avoided. It can also prevent the oil in the oil container 2 from leaking out. The atomizer 3 is ensured to produce smoke with steady volume. In the embodiment, the axis of the liquid delivery element 311 and the axis of the fixed sleeve 33 are overlapped. Of course, the axis of the liquid delivery element 311 and the axis of the fixed sleeve 33 may be parallel to each other or form a certain angle, and it is unlimited there.

In the embodiment, a nonwoven fabric layer 323, a cotton core layer 324 and a composite cotton layer 325 are successively provided in the oil latch element 322. The liquid delivery element 311 abuts against the nonwoven fabric layer 323. Comparing with the oil latch element 322 made of single material, the oil latch element 322 made of various different material with different oil absorption ability has better oil absorption effect and can deliver the oil better to the heating wire 312 of the heating wire assembly 31 to be atomized to increase the volume of the smoke. In additional, as the cotton core layer 324 and the composite cotton layer 325 can absorb large amount of oil, the nonwoven fabric layer 323 is provided on the cotton core layer 324 to buffer the oil and prevent a large amount of oil from flowing into one end of the liquid delivery element 311 to cause oil leakage.

Figure 4:
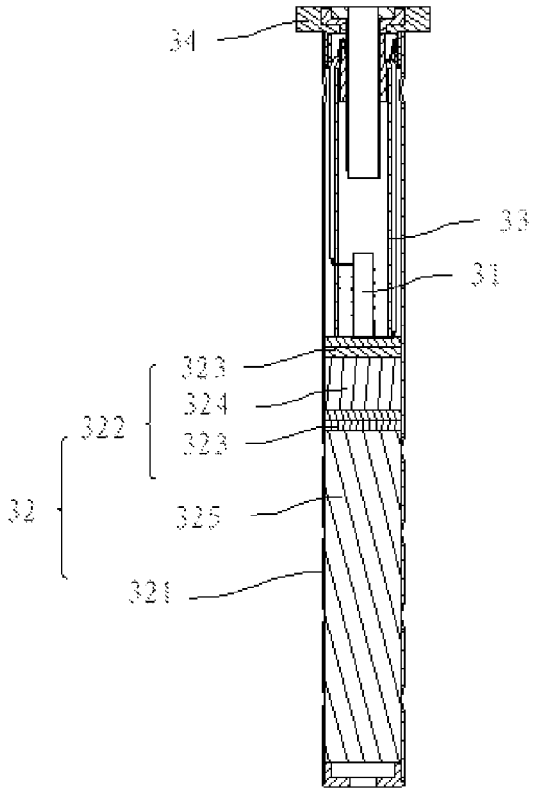
FIG. 4 is a structural diagram of the heating wire assembly, the oil delivery mechanism and the first electrode connecting element of the atomizer shown in FIG. 2 according to another embodiment of the present invention.
Figure 5:
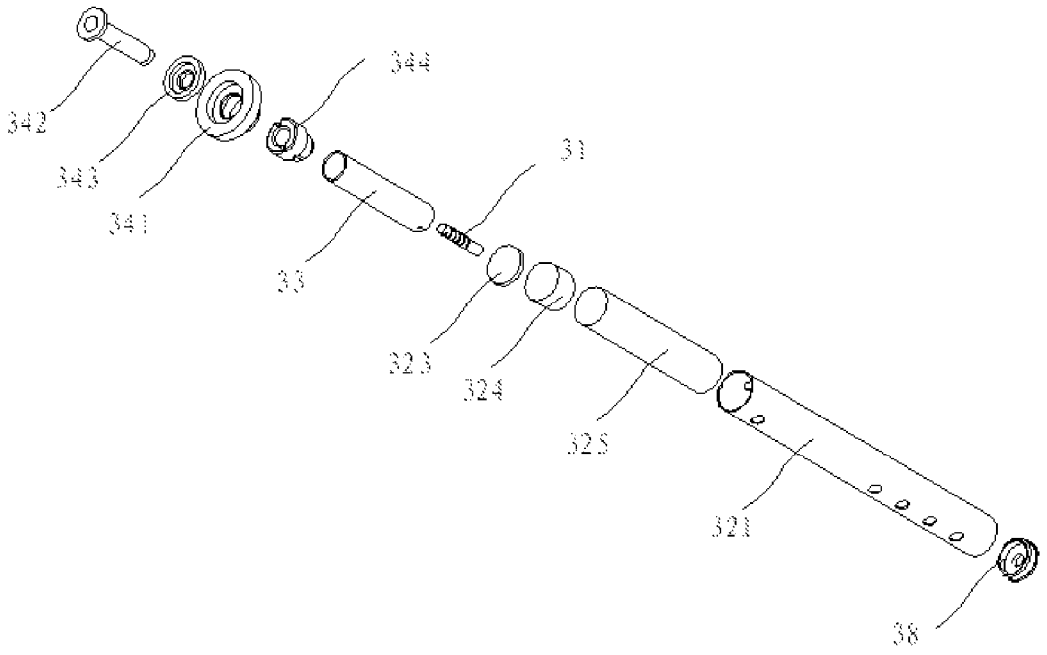
FIG. 5 is an exploded view of the atomizer shown in FIG. 2.

In other embodiments, oil leakage can be avoided further by increasing the amount of the nonwoven fabric layer 323, or by adding at least one nonwoven fabric layer 323 between the cotton core layer 324 and the composite cotton layer 325. Referring to FIG. 4, two nonwoven fabric layers 323, the cotton core layer 324 and two nonwoven fabric layers 323 and the composite cotton layer 325 are provided in turn to form the oil latch element 322. It should be understood that the specific structure of the oil latch element 322 is not limited in the embodiment, as long as the oil latch element 322 is made of the material with oil absorption ability and capable of absorbing and delivering oil.

The fixed sleeve 33 is approximately in form of a cylinder. The fixed sleeve 33 is a glass fiber sleeve made of glass fiber. The glass fiber sleeve is capable of absorbing oil, with excellent heat-resistance, and can avoid being charred better. One end of the fixed sleeve 33 is connected to the first electrode connecting element 34 by a plug connection, and the fixed sleeve 33 is sleeved within one end of the oil conduit 321, opposite to the oil container 2. Furthermore, the heating wire assembly 31 is received in the fixed sleeve 33. The liquid delivery element 311 is provided along the axial direction of the fixed sleeve 33. The two ends of the heating wire 312 twined around the liquid delivery element 311 respectively pass through the fixed sleeve 33 and connect to the first electrode connecting element 34.

Advantageously, in order to make the heating wire 312 atomize oil better and ensure the atomizer 3 to produce stable volume of smoke, the length that the liquid delivery element 311 extends out of the fixed sleeve 33 at the end close to the oil latch element is 1 mm-10 mm, the length between the end of the heating wire 312 that near the oil latch element 322 and the tail end of the fixed sleeve 33 (that is the end of the fixed sleeve 33 that near the oil latch element 322) is 0 mm-5 mm, and the spacing between the end of the liquid delivery element 311 that near the oil latch element 322 and the nonwoven fabric layer 323 is 0 mm-3 mm.

Specifically, in the embodiment, at least two through holes (unlabeled) configured to be extended through by the heating wire 312 are defined on the peripheral wall of the fixed sleeve 33. One end of the heating wire 312 passes through the through holes to electrically connect to a first electrode 341 of the first electrode connecting element 34, the other end of the heating wire 312 passes through the bottom of the fixed sleeve 33 to electrically connect to a second electrode 342 of the first electrode connecting element 34.

Furthermore, airflow can circulate through the through holes defined on the peripheral wall of the fixed sleeve 33. In the embodiment, airflow enters into the fixed sleeve 33 through the inlet hole defined on the atomization sleeve 30 and the through holes, so the airflow circulates without passing through the oil container 2, and it can prevent the oil from leaking and avoid the users sucking the oil.

The first electrode connecting element 34 is located in one end of the atomization sleeve 30, opposite to the oil container 2. The first electrode connecting element 34 is mainly configured to connect to the battery assembly 4 and the heating wire assembly 31 respectively and provide working power for the heating wire assembly 31. In the embodiment, the first electrode connecting element 34 comprises the first electrode 341, the second electrode 342, and a first insulating ring 340 sleeved between the first electrode 341 and the second electrode 342 and configured for electrical insulation.

Specifically, in the embodiment, the first insulating ring 340 comprises a first up insulating ring 343 and a first down insulating ring 344 which are sleeved between the first electrode 341 and the second electrode 342 respectively. Referring to FIG. 3, one end of the heating wire 312 is clamped between the internal peripheral surface of the first down insulating ring 344 and the external peripheral surface of the second electrode 342. The other end of the heating wire 312 is clamped between the external peripheral surface of the first down insulating ring 344 and the internal peripheral surface of the first electrode 341.

When assembling, the two extending ends of the heating wire 312 are respectively inserted between the first down insulating ring 344 and the second electrode 342 and between the first down insulating ring 344 and the first electrode 341. Therefore, the welding connection in prior art is not adopted when the heating wire 312 is assembled, and the atomizer 3 can be assembled without complex operations. Thus, it is convenient to assemblers, the assembling efficiency can be improved, production cost can be saved and the requirement to assemblers is reduced. By the means of clamping, the first electrode connecting element 34 is enabled to deliver power to the heating wire assembly 31, which is convenient for assembling, can improve the stability of the electrical connection between the first electrode connecting element 34 and the heating wire assembly 31 and can prevent rosin joint that will cause the atomizer 3 failed to work from happening.

Furthermore, a vent hole (unlabeled) is extended through the second electrode 342 along an axial direction and is connected to the fixed sleeve 33. The vent hole is the smoke outlet of the atomizer 3. The smoke produced by the heating wire assembly 31 is discharged through the vent hole. The arrows in FIG. 3 show the flowing direction of the smoke. As the air flows without passing through the oil container 2, the oil leakage can be prevented effectively and the situation that users suck oil can be avoided.

In the embodiment, the structures of the first electrode 341 and the second electrode 342 are common structures in prior art, and they are not detailed there.

The first connecting element 35 is connected to one end of the atomization sleeve 30, opposite to the oil container 2. The first connecting element 35 is mainly configured to detachably connect to the battery assembly 4. Meanwhile, the first connecting element 35 is configured to fix the first electrode connecting element 34. The first electrode connecting element 34 is fixed in the first connecting element 35. In the embodiment, the structure of the first connecting element 35 is external threaded structure. The first connecting element 35 may be provided as other structures if other detachably connecting structure is used, for example, a clamping connection with an elastic strip. In the embodiment, the threaded connection is just used as an example, but it is not limited to the thread connection.

The second connecting element 36 is connected to one end of the atomization sleeve 30, close to the oil container 2. The second connecting element 36 is mainly configured to detachably connect to the oil container 2. In the embodiment, the structure of the second connecting element 36 is also an external threaded structure, but it is not limited to adopt the threaded structure.

The elastic sealing element 37 is located between the oil container 2 and the oil conduit 321 and is configured to obtain a sealed connection between the atomizer 3 and the oil container 2 and avoid oil leakage. Specifically, an opening is defined on one end of the oil container 2, facing the atomizer 3. The oil delivery mechanism 32 is inserted into the oil container 2 through the opening. The elastic sealing element 37 is sleeved on the oil conduit 321, corresponding to the opening, and is configured to seal oil.

The bottom cap 38 is fixed in one end of the oil conduit 321, wherein the end of the oil conduit 321 is inserted into the oil container 2. A through-hole (unlabeled) is defined in the bottom cap 38 along an axial direction and is configured to provide flow path for oil. The bottom cap 38 is mainly configured to seal the oil conduit 321 and to avoid the oil latch element 322 in the oil conduit 321 slipping off from one end of the oil conduit 321 to impact the oil absorbing effect of the oil latch element 322.

It should be understood that the structure of the atomizer 3 in this embodiment is a preferred structure, and it is not limited to above structure as long as the liquid delivery element 311 of the heating wire assembly 31 is provided along an axial direction of the atomizer 3 to increase the length of the heating wire 312 twined around the liquid delivery element 311.

In the following, the detailed structure of the oil container 2 of the atomization assembly is described in detail combining the embodiment shown in FIG. 2.

Referring to FIG. 2, the opening is defined on one end of the oil container 2, facing the atomizer 3. The opening is configured to insert the oil delivery mechanism 32. A sealed receiving cavity is defined in the oil container 2 and oil is hermetically stored in the sealed receiving cavity. In order to make users know the remaining volume of oil in the oil container 2, the oil container 2 may be made of light transmitting material, that is, the oil container 2 is a transparent or semitransparent container. Advantageously, the oil container 2 is made of transparent material, so users can know the remaining volume of oil through the transparent oil container 2 at any time, which is convenient for uses to change the oil container 2 in time.

Advantageously, the oil container 2 is a glass bottle. As the character of glass is stable, the situation which will impact the taste of the oil, such as, chemical reaction, can be avoided.

Advantageously, scales are provided on the external peripheral wall of the oil container 2, so that the working time that the remaining oil can last can be estimated by the users, and it is convenient for the users to use.

Furthermore, a protecting sleeve (not shown) is sheathed on the oil container 2 to avoid the oil container 2 made of glass being damaged when it falls.

Advantageously, an oil observing window (not shown) is provided on the protecting sleeve. So the users can observe the remaining oil through the oil observing window.

When assembling, the atomizer 3 and the oil container 2 are assembled respectively firstly and then the atomizer 3 is fixedly mounted in the oil container 2.

Figure 6:
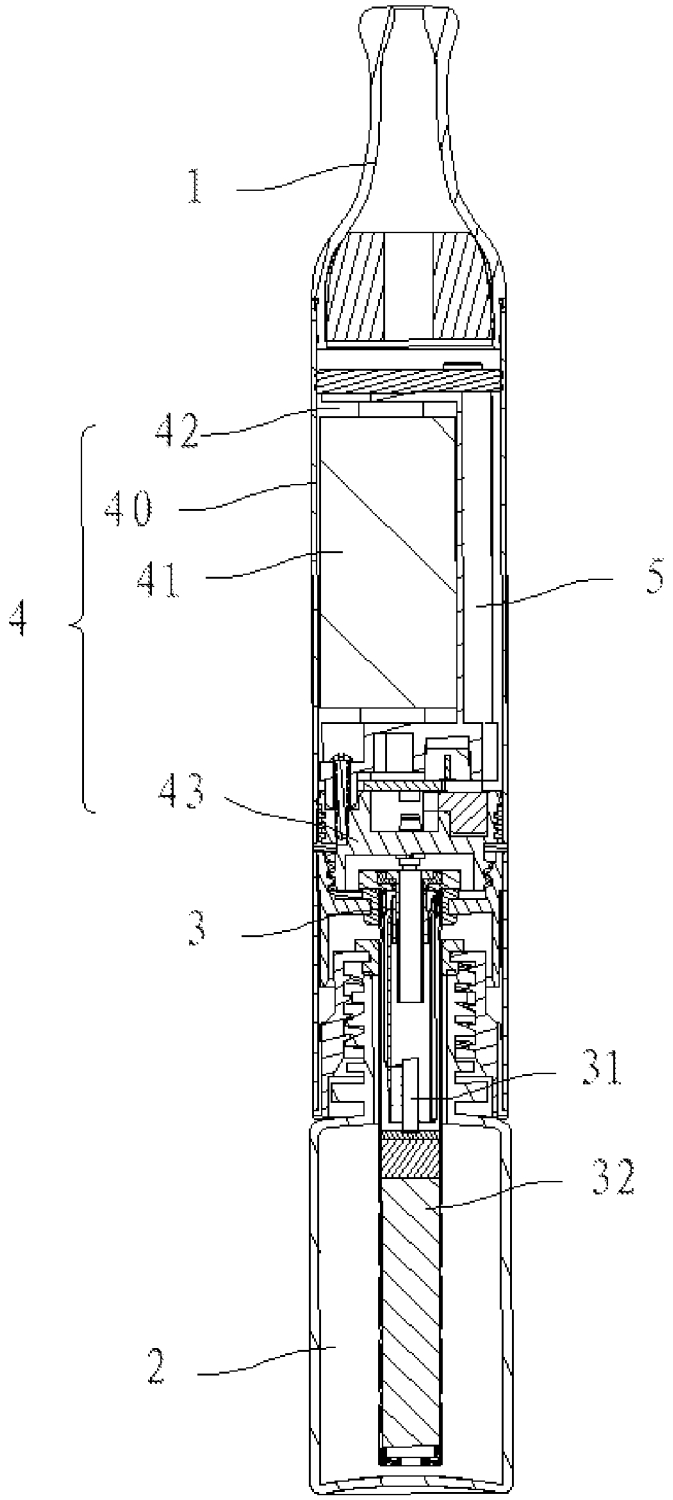
FIG. 6 is a structural diagram of an electronic cigarette according to a preferred embodiment of the present invention.

Referring to FIG. 6, the present invention provides an electronic cigarette further. The electronic cigarette comprises an electronic cigarette body. A smoking end 1, an atomization assembly configured to atomize oil and a battery assembly 4 electronic connected to the atomization assembly and configured to supply power to the atomization assembly are provided on the electronic cigarette body. The atomization assembly is the atomization assembly described above. Specifically, the atomization assembly comprises the atomizer 3, and the oil container 2 detachably connected to one end of the atomizer 3. The oil container 2 is provided on one end of the electronic cigarette body, opposite to the smoking end 1. The atomizer 3 is provided between the battery assembly 4 and the oil container 2.

Furthermore, a smoking channel 5, connected to the smoking end 1 and configured to discharge the smoke formed in the process of atomizing the oil by the heating wire assembly 31, is formed in the electronic cigarette body.

In the embodiment, the oil container 2 is provided on one end of the electronic cigarette body, opposite to the smoking end 1. The advantage of this structure is, the smoke discharged from the atomizer 3 that atomizes the oil doesn't pass through the oil container 2, so the heat of the smoke will not be absorbed by the oil, and the situation in the prior art that the smoke is condensed due to its heat being absorbed by the oil can be avoided. The atomizer 3 is provided on one end of the battery assembly 4, opposite to the smoking end 1, that is, the atomizer 3 is opposite to the mouth of the user. Therefore, the users are prevented from being scalded by the heat produced by atomizer 3 when atomizing the oil and the using safety of the electronic cigarette is improved. Additionally, the users may clamp the electronic cigarette at a position where the battery assembly 4 locates when using the electronic cigarette to smoke, and may avoid clamping the heated atomizer 3. Therefore, using the electronic cigarette of the present invention, the situations that hands of the users are scalded can be avoided. The temperature of the real cigarette is simulated effectively by the electronic cigarette of the present invention, and the using experience of smoking is improved.

Additionally, the atomizer 3 and the battery assembly 4 are provided coaxially, and the atomizer 3 is provided between the battery assembly 4 and the oil container 2. That is, the atomizer 3 is opposite to the smoking end, so the atomizer 3 is opposite to the mouth of the user when the users using the electronic cigarette of the present invention to smoke. So the situation that the users are scalded by the heat produced by the atomizer 3 when atomizing the oil can be avoided and the using safety of the electronic cigarette is improved. Additionally, the users may naturally clamp the battery assembly 4 when using the electronic cigarette to smoke, and may avoid clamping the heated atomizer 3. Therefore, using the electronic cigarette of the present invention, the situations that hands of the users are scalded can be avoided. The temperature of the real cigarette is simulated effectively by the electronic cigarette of the present invention, and the using experience of smoking is improved.

In the following, the specific structure of the battery assembly 4 will be described in detail combining with the embodiment shown in FIG. 6.

Referring to FIG. 6, the battery assembly 4 is provided between the smoking end 1 and the atomizer. The battery assembly 4 mainly comprises a battery sleeve 40, a battery 41, a battery bracket 42, a third connecting element 43, a second electrode connecting element, a control unit and an airflow sensor (all unlabeled).

The battery sleeve 40 is approximately in form of a hallow cylinder. The end of the battery sleeve 40 extends to integrally form the smoking end 1 shown in FIG. 6. The mouthpiece of the smoking end 1 and the battery sleeve 40 may also be detachably connected to each other. The specific connection between the smoking end 1 and the battery sleeve 40 is unlimited in the embodiment. In the embodiment, the mouthpiece and the battery sleeve 40 are detachably connected to each other, so the users can change or clean the mouthpiece at any time. Thus, the situation that the oil in the mouthpiece is sucked by the users can be avoided, and the oil in the battery assembly 4 can be cleaned better.

The battery 41 is received in the battery sleeve 40 and is configured to supply power needed for working to the heating wire assembly 31 of the atomizer.

The battery bracket 42 is approximately in form of a cylinder. The battery bracket 42 is mainly configured to fix the battery 41. A receiving space (unlabeled) configured to fix the battery 41 is defined in the battery bracket 42. The battery bracket 42 is sheathed in the battery sleeve 40 and is arranged along the axial direction of the battery sleeve 40. Additionally, at least one channel extending through the battery bracket 42 along the axial direction of the battery bracket 42, is provided in the battery bracket 42. The channel is a part of the smoking channel 5.

The third connecting element 43 is connected to one end of the battery sleeve 40, close to the atomizer. The battery sleeve 40 and the atomizer are detachably connected to each other through the third connecting element 43. In the embodiment, the third connecting element 43 is an internal threaded structure matching with the first connecting element 35. The third connecting element 43 may be provided as other structure if other detachably connecting structure is used, for example, a clamping connection with an elastic strip. In the embodiment, the threaded connection is just used as an example, but it is not limited to using the threaded connection.

The second electrode connecting element is connected to the two electrodes of the battery 41 respectively and is fixed at one end of the battery bracket 42, close to the atomizer. The second electrode connecting element is mainly configured to electronically connect to the atomizer. In the embodiment, the structure of the second electrode connecting element is common structure in prior art, and there is no need to be detailed here.

The airflow sensor is located at one side of the battery sleeve 40, close to the smoking end 1. The airflow sensor is mainly configured to detect airflow signal and to produce pulse signal. In the embodiment, as the airflow sensor is near the smoking end 1, the sensitivity of the airflow sensor for sensing the smoking motion of the users is improved, which will be convenient for the users to use the electronic cigarette more effectively.

The control unit is fixed at one side of the battery sleeve 40, the one side is close to the smoking end 1. The control unit is connected to the airflow sensor and the battery 41 respectively. The control unit is mainly configured to receive the signal sent by the airflow sensor and to control the working state of the atomizer based on the received signal.

It should be understood that the battery assembly 4 in the embodiment is mainly configured to supply power to the atomizer. The battery assembly 4 mainly comprises the battery sleeve 40, the battery 41, the battery bracket 42, the third connecting element 43, the second electrode connecting element, the control unit and the airflow sensor. In the embodiment, the specific structure of the battery assembly 4 is not limited, provided that the battery assembly 4 can provided enough power to make the atomizer work.

In the following, the specific structure of the smoking channel 5 will be described in detail combining with the embodiment shown in FIG. 6.

Referring to FIG. 6, the smoking channel 5 is mainly configured to circulate the atomized oil. The smoking channel 5 is provided along the axial direction of the electronic cigarette body and is connected to the smoking end 1. The smoke produced by the atomizer 3 is discharged from the smoke outlet to the channel in the battery bracket 42, to the smoking end 1 successive, and then the smoke is smoked by the users.

Additionally, an air inlet (unlabeled) is defined on the electronic cigarette body and is connected to the smoking channel 5. There are two means for defining the air inlet. However, it should be clarified that the means for defining the air inlet are not limited, provided that the air inlet defined on the electronic cigarette body is connected to the smoking end 1 through the smoking channel 5.

The first means: the air inlet is defined on the abutting surface between the atomizer 3 and the oil container 2. Specifically, a bump or a ridge part is provided on the abutting surface between the atomizer 3 and the oil container 2. Accordingly, the air inlet configured to circulate air is formed between the atomizer 3 and the oil container 2 after they are screwed to each other, and the air flows into the smoking channel 5 through the air inlet.

The second means: the air inlet is defined on the outer wall of the atomizer 3, and air flow into the smoking channel 5 through the air inlet. It should be clarified that the specific location and quantity of the air inlet are not limited here.

When assembling, the atomizer 3, the battery assembly 4 and the oil container 2 are respectively assembled firstly, then the atomizer 3 is fixedly mounted in the oil container 2, and at last the atomizer 3 connected to the oil container 2, the battery assembly 4 and the smoking end 1 are connected in turn. After assembling, the first electrode connecting element 34 of the atomizer and the second electrode connecting element of the battery assembly 4 are electronically connected.

In conclusion, using the electronic cigarette provided in the above embodiment, the following advantageous effects can be achieved:

(1) the liquid delivery element of the heating wire assembly is provided along the axial direction of the atomizer, thus the length of the heating wire twined around the liquid delivery element is increased, and the volume of the smoke is hence increased, so sufficient smoke is provided for the users to meet the demands of the users with large vital capacity and the using experience of the uses can be improved.

(2) the smoking channel of the electronic cigarette doesn't pass through the oil container, the situation that the oil flows into the smoking channel is prevented and the situation that the smoke is condensed due to its heat being absorbed by the oil can be avoided, so it can avoid users sucking the oil and influencing users' experience.

(3) by clamping connection, the first electrode and the second electrode are electronically connected to the heating wire, the welding connection in prior art are not adopted, so the atomizer can be assembled without complex operations, it is convenient to assemblers, the assemble efficiency can be improved, production cost can be saved and the requirement to assemblers is reduced.

(4) the atomizer of the electronic cigarette is detachably provided in the oil container, which is convenient for users to change the atomizer if the atomizer is damaged and to add oil into the oil container or change the oil container.

(5) as the oil container is provided on one end of the electronic cigarette body, opposite to the smoking end, the oil container configured to store the oil is opposite to the smoking end. When using the electronic cigarette, the situation that the users suck the oil which will impact the experience can be avoided.

(6) the battery assembly is provided between the oil container and the smoking end, and the atomizer is provided between the battery assembly and the oil container, so the atomizer is opposite to the smoking end and the atomizer is opposite to the mouth of the user when the users using the electronic cigarette to smoke. Therefore, the situation that the users are scalded by the heat produced by atomizer when atomizing the oil can be avoided and the using safety of the electronic cigarette is improved. Additionally, the users may naturally clamp the battery assembly 4 when using the electronic cigarette to smoke, and may avoid clamping the heated atomizer 3. Therefore, using the electronic cigarette, the situations that hands of the users are scalded can be avoided. The temperature of the real cigarette is simulated effectively by the electronic cigarette of the present invention, and the using experience of smoking is improved.

(7) as the oil container is provided opposite to the mouthpiece, the oil container is free from the external clamping force. The oil is output stably to the atomizer from the oil container, so the stability of the smoke produced is improved effectively.

(8) the smoking end of the electronic cigarette is detachably connected to the battery assembly, so it is convenient for users to disassemble and clean the smoking end.

Figure 7:
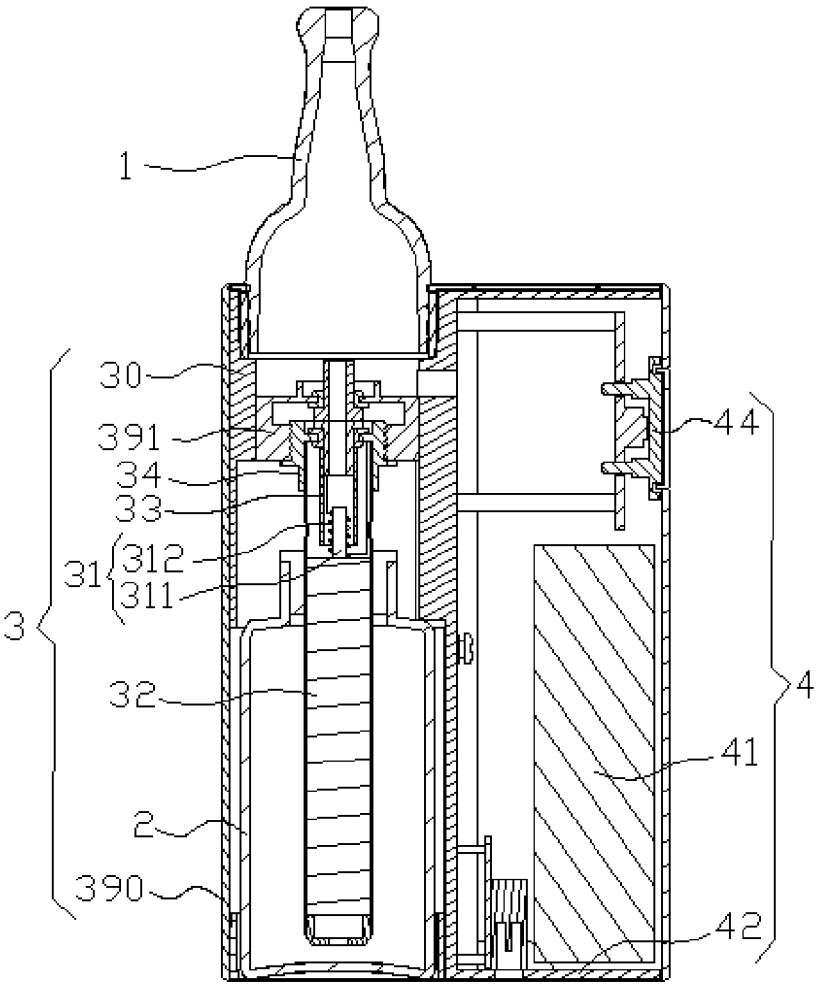
FIG. 7 is a structural diagram of the electronic cigarette according to another preferred embodiment of the present invention.

Referring to FIG. 7, it is the structure diagram of the electronic cigarette according to another embodiment of the present invention. The structure of the electronic cigarette of this embodiment is similar to that of the above embodiment. The similarities are as follows: both electronic cigarettes comprise the electronic cigarette body; the smoking end 1, the atomizer 3, the battery assembly 4 and the oil container 2 detachably connected to one end of the atomizer 3 are provided in the electronic cigarette body; the oil container is provided on one end of the electronic cigarette body, opposite to the smoking end 1; the smoke outlet is defined at one end of the atomizer 3, opposite to the oil container 2 and is configured to discharge the smoke produced by atomizing; the atomizer 3 comprises the atomization sleeve 30; the heating wire assembly 31, and the oil delivery mechanism 32 inserted into the oil container and configured to deliver oil to the heating wire 31 to be atomized are provided in the atomization sleeve 30; the heating wire assembly 31 comprises the liquid delivery element 311 provided along the axial direction of the atomizer 3, and the heating wire 312 twined around the liquid delivery element 311; the first electrode connecting element 34 electronically connected to the heating wire assembly 31, and the fixed sleeve 33 abutted against the first electrode connecting element 34 are provided in one end of the atomization sleeve 30; the heating wire assembly 31 is received in the fixed sleeve 33, and the liquid delivery element 311 is fixed along the axial direction of the fixed sleeve 33; the battery assembly 4 comprises the battery bracket 42 and the battery 41 provided in the battery bracket 42.

The differences between the electronic cigarette of the embodiment and the electronic cigarette of above embodiment are as follows: in the embodiment, the battery assembly 4 and the atomization assembly are arranged side by side; the atomization sleeve 30 of the atomization assembly and the battery bracket 42 are integrally formed; a protection cover 390 is provided out of the atomization sleeve 30, the protection cover 390 can slide along the axial direction of the electronic cigarette body and covers the outer wall of the oil container 2; a second electrode connecting element 391 is provided in the atomization sleeve 30 and is electronically connected to the first electrode connecting element 34 and the battery 41; a key switch 44 electronically connected to the first electrode connecting element 34 and the battery 41, configured to control the battery 41 to supply power to the heating wire 312, is provided on the side surface of the battery assembly 4.

As the liquid delivery element of the heating wire assembly is fixed along the axial direction of the atomizer, and the oil container is detachably connected to one end of the electronic cigarette body, opposite to the smoking end, the electronic cigarette in the embodiment has the advantageous effects corresponding to above embodiment. Additionally, as the battery assembly and the atomization assembly are arranged side by side, the length of the electronic cigarette is shorter and it is convenient to carry. The oil container 2 can be protected better through the protection cover 390.

Although the present invention is explained through specific embodiments, it is understandable to one of ordinary skill in the art that a plurality of variants and alternatives can be obtained from the present invention without exceeding the scope of the present invention. In addition, the present invention can be modified according to specific situation or material without exceeding the scope of the present invention. Therefore, the present invention is not limited to the published specific embodiment(s), but should comprise all embodiments that fall within the scope of claims of the present invention.

What is claimed is:

1. An atomization assembly, configured to combine with a battery assembly (4) to form an electronic cigarette, wherein the atomization assembly comprises:

an atomizer (3), and an oil container (2) detachably connected to one end of the atomizer (3); a smoke outlet configured to discharge atomized smoke is defined on the other end of the atomizer (3), and the other end is opposite to the oil container (2); the atomizer (3) comprises an atomization sleeve (30), a heating wire assembly (31) provided in the atomization sleeve (30), and an oil delivery mechanism (32) inserted into the oil container (2) and configured to deliver oil to be atomized to the heating wire assembly (31); the heating wire assembly (31) comprises a liquid delivery element (311) extended along an axial direction of the atomizer (3), and a heating wire (312) twined around the liquid delivery element (311);

wherein the atomizer (3) is defined side by side with the battery assembly (4);

wherein the oil delivery mechanism (32) comprises an oil conduit (321), and an oil latch element (322) received in the oil conduit (321) and made of oil absorption material; an external peripheral wall of the oil latch element (322) is fit with an internal peripheral wall of the oil conduit (321); the heating wire assembly (31) is received in the oil conduit (321); an end of the liquid delivery element (311) abuts against the oil latch element (322); and wherein a first electrode connecting element (34) configured to electronically connected to the battery assembly (4) is inserted in an end of the oil conduit (321); the heating wire (312) is electronically connected to the first electrode connecting element (34);

wherein an opening is defined on an end of the oil container (2), the end is facing the atomizer (3); the oil delivery mechanism (32) is inserted into the oil container (2) through the opening; an elastic sealing element (37) configured to seal oil is sleeved on a location of the oil conduit (321), the location is corresponding to the opening;

wherein the oil latch element (322) and the liquid delivery element (311) are both in form of a solid cylinder; an axis of the liquid delivery element (311) is overlapped with or parallel to that of the oil latch element (322), and a cross sectional area of the oil latch element (322) is greater than that of the liquid delivery element (311);

wherein at least one nonwoven fabric layer (323), a cotton core layer (324) and a composite cotton layer (325) are successively provided in the oil latch element (322); the liquid delivery element (311) abuts against the nonwoven fabric layer (323);

wherein at least one nonwoven fabric layer (323) is provided between the cotton core layer (324) and the composite cotton layer (325);

wherein a fixed sleeve (33) made of glass fiber is sleeved in the oil conduit (321), and one end of the fixed sleeve (33) is connected to the first electrode connecting element (34) by a plug connection; the heating wire assembly (31) is received in the fixed sleeve (33);

wherein the first electrode connecting element (34) comprises a first electrode (341), a second electrode (342), and a first insulating ring (340) sleeved between the first electrode (341) and the second electrode (342) and configured for electrical insulation; the first electrode (341) and the second electrode (342) are respectively and electronically connected to two ends of the heating wire (312);

wherein a second electrode connecting element (391) is provided in the atomization sleeve (30) and is electronically connected to the first electrode connecting element (34) and the battery assembly (4).

2. An electronic cigarette, comprising an electronic cigarette body; wherein a smoking end (1), an atomization assembly configured to atomize oil and a battery assembly (4) electrically connected to the atomization assembly and configured to supply power to the atomization assembly are provided on the electronic cigarette body; the atomization assembly comprises an atomizer (3), and an oil container (2) detachably connected to one end of the atomizer (3); a smoke outlet configured to discharge atomized smoke is defined on the other end of the atomizer (3), the other end is opposite to the oil container (2); the oil container (2) is arranged at one end of the electronic cigarette body, the end is opposite to the smoking end (1); and wherein the atomizer (3) comprises an atomization sleeve (30), a heating wire assembly (31) provided in the atomization sleeve (30), and an oil delivery mechanism (32) inserted into the oil container (2) and configured to deliver oil to be atomized to the heating wire assembly (31); the heating wire assembly (31) comprises a liquid delivery element (311) extended along an axial direction of the atomizer (3), and a heating wire (312) twined around the liquid delivery element (311);

wherein the atomizer (3) is defined side by side with the battery assembly (4);

wherein the oil delivery mechanism (32) comprises an oil conduit (321), and an oil latch element (322) received in the oil conduit (321) and made of oil absorption material; an external peripheral wall of the oil latch element (322) is fit with an internal peripheral wall of the oil conduit (321); the heating wire assembly (31) is received in the oil conduit (321); an end of the liquid delivery element (311) abuts against the oil latch element (322); and wherein a first electrode connecting element (34) configured to electronically connected to the battery assembly (4) is inserted in an end of the oil conduit (321); the heating wire (312) is electronically connected to the first electrode connecting element (34);

wherein an opening is defined on an end of the oil container (2), the end is facing the atomizer (3); the oil delivery mechanism (32) is inserted into the oil container (2) through the opening; an elastic sealing element (37) configured to seal oil is sleeved on a location of the oil conduit (321), the location is corresponding to the opening;

wherein the oil latch element (322) and the liquid delivery element (311) are both in form of a solid cylinder; an axis of the liquid delivery element (311) is overlapped with or parallel to that of the oil latch element (322), and a cross sectional area of the oil latch element (322) is greater than that of the liquid delivery element (311);

wherein a fixed sleeve (33) made of glass fiber is sleeved with the oil conduit (321), and one end of the fixed sleeve (33) is connected to the first electrode connecting element (34) by a plug connection; the heating wire assembly (31) is received in the fixed sleeve (33);

the first electrode connecting element (34) comprises a first electrode (341), a second electrode (342), and a first insulating ring (340) sleeved between the first electrode (341) and the second electrode (342) and configured for electrical insulation; the first electrode (341) and the second electrode (342) are respectively and electronically connected to two ends of the heating wire (312);

wherein a second electrode connecting element (391) is provided in the atomization sleeve (30) and is electronically connected to the first electrode connecting element (34) and the battery assembly (4).

3. The atomization assembly according to claim 1, wherein a length that the liquid delivery element (311) extends out of the fixed sleeve (33) at an end close to the oil latch element (322) is 1 mm to 10 mm, a length between an end of the heating wire (312) that near the oil latch element (322) and an end of the fixed sleeve (33) that near the oil latch element (322) is 0 mm to 5 mm, and a spacing between an end of the liquid delivery element (311) that near the oil latch element (322) and the nonwoven fabric layer (323) is 0 mm to 3 mm.

4. The electronic cigarette according to claim 2, wherein a length that the liquid delivery element (311) extends out of the fixed sleeve (33) at an end close to the oil latch element (322) is 1 mm to 10 mm, a length between an end of the heating wire (312) that near the oil latch element (322) and an end of the fixed sleeve (33) that near the oil latch element (322) is 0 mm to 5 mm, and a spacing between an end of the liquid delivery element (311) that near the oil latch element (322) and the nonwoven fabric layer (323) is 0 mm to 3 mm.

* * * * *